US009121139B2

(12) United States Patent
Delucia et al.

(10) Patent No.: US 9,121,139 B2
(45) Date of Patent: Sep. 1, 2015

(54) TRACK MAINTENANCE APPARATUS AND METHOD

(71) Applicant: Harsco Corporation, Camp Hill, PA (US)

(72) Inventors: Anthony P. Delucia, Gaston, SC (US); Peter R. Maurice, Irmo, SC (US); Robert S. Miller, Columbia, SC (US)

(73) Assignee: HARSCO CORPORATION, Camp Hill, PA (US)

( * ) Notice: Subject to any disclaimer, the term of this patent is extended or adjusted under 35 U.S.C. 154(b) by 211 days.

(21) Appl. No.: 13/734,883

(22) Filed: Jan. 4, 2013

(65) Prior Publication Data

US 2014/0013991 A1 Jan. 16, 2014

Related U.S. Application Data

(60) Provisional application No. 61/671,491, filed on Jul. 13, 2012.

(51) Int. Cl.
*E01B 29/00* (2006.01)
*E01B 29/32* (2006.01)

(52) U.S. Cl.
CPC ..... *E01B 29/00* (2013.01); *E01B 29/32* (2013.01)

(58) Field of Classification Search
CPC ..... E01B 27/17; E01B 2203/12; E01B 29/32; E01B 27/16; E01B 29/28
USPC ..... 104/17.2, 15, 2, 12
See application file for complete search history.

(56) References Cited

U.S. PATENT DOCUMENTS 3,687,081 A * 8/1972 Plasser et al. ..... 104/12
5,694,856 A * 12/1997 Theurer ..... 104/17.2
2011/0120341 A1* 5/2011 Kelly et al. ..... 104/287

FOREIGN PATENT DOCUMENTS

JP 5-140904 * 6/1993
JP H05-140904 A 6/1993

* cited by examiner

*Primary Examiner* — Mark Le
(74) *Attorney, Agent, or Firm* — Baker & McKenzie LLP

(57) ABSTRACT

In an aspect, a track maintenance vehicle includes a body, a work head, and a controller. The work head performs track maintenance and is coupled to the body. The controller is configured to operate the vehicle in an autonomous mode. In another aspect, an anchor adjustor includes first and second jaws and an actuator. The jaws pivot about a single axis. The actuator causes the jaws to rotate about the axis. In another aspect, an anchor adjustor assembly includes a first pair of jaws, a second pair of jaws and an actuator. The first and second pairs of jaws open and close about a rail in a track. The actuator causes the closed first pair of jaws to translate towards the closed second pair of jaws along a longitudinal direction of the rail.

10 Claims, 8 Drawing Sheets

TRACK MAINTENANCE APPARATUS AND METHOD

CROSS-REFERENCE TO RELATED APPLICATIONS

This application claims priority to U.S. Provisional App. Ser. No. 61/671,491, filed Jul. 13, 2012, which is hereby incorporated by reference in its entirety.

BACKGROUND

The present application relates generally to railway maintenance and includes methods and apparatus for improving track maintenance operations.

Generally, a railroad includes at least one pair of elongated, substantially parallel rails coupled to a plurality of laterally extending ties, which are disposed on a ballast bed. The rails are coupled to the ties by tie plates and spikes and/or spring clip fasteners, which is an example of a class of fasteners that may be referred to as anchors. The ballast is generally hard particulate material such as, but not limited to, gravel. The ballast filled space between ties is referred to as a crib. Ties may be crooked or skewed and not extend generally laterally, i.e. perpendicular to, the rails.

During installation and maintenance, various operations may be performed at tie locations. For example, ballast may need to be tamped, or compressed, to ensure that the ties, and therefore the rails do not shift and are positioned correctly; anchors may need to be tightened; or ties may need to be replaced.

Track maintenance activities generally require multiple operators riding on the track maintenance equipment or controlling it from alongside the railroad. It would be desirable to reduce the number of operators needed to perform track maintenance operations.

Track maintenance equipment typically moves from tie to tie to perform operations. These machines accelerate (under their own power) to the ties requiring work. As they approach the tie, they slow down to a stop, perform the required work and move on to the next tie to repeat the cycle. This results in slow progress of work, increased energy usage, and increased wear on parts of the equipment from repeated acceleration and deceleration. It would be desirable to reduce the acceleration and deceleration, and associated innefficiency, involved in the track maintenance operations.

BRIEF SUMMARY

In an embodiment, a track maintenance vehicle for performing maintenance on a track includes a body, one or more work heads, and a controller. The one or more work heads perform track maintenance and are coupled to the body. The controller is configured to operate the vehicle in an autonomous mode.

In another embodiment, an anchor adjustor includes first and second jaws and an actuator. The first and second jaws pivot about a single axis. The actuator causes the first and second jaws to rotate about the axis.

In still another embodiment, an anchor adjustor assembly includes a first pair of jaws, a second pair of jaws and an actuator. The first pair of jaws open and close about a rail in a track. The second pair of jaws open and close about the rail in the track and are disposed a distance from the first pair of jaws in the longitudinal direction of the rail. The actuator causes the closed first pair of jaws to translate towards the closed second pair of jaws.

DETAILED DESCRIPTION

Embodiments described herein relate generally to an apparatus for railway maintenance and methods for performing railway maintenance. In some embodiments, an improved railway maintenance vehicle is provided. In other embodiments, an improved work head is provided. It will be appreciated that the following discussion is exemplary in nature of the described principals. For example, unless specifically described to the contrary, it will be understood that the various described embodiments may be used separately or together whether or not a specific combination is described or a particular aspect is described independently.

Figure 1:
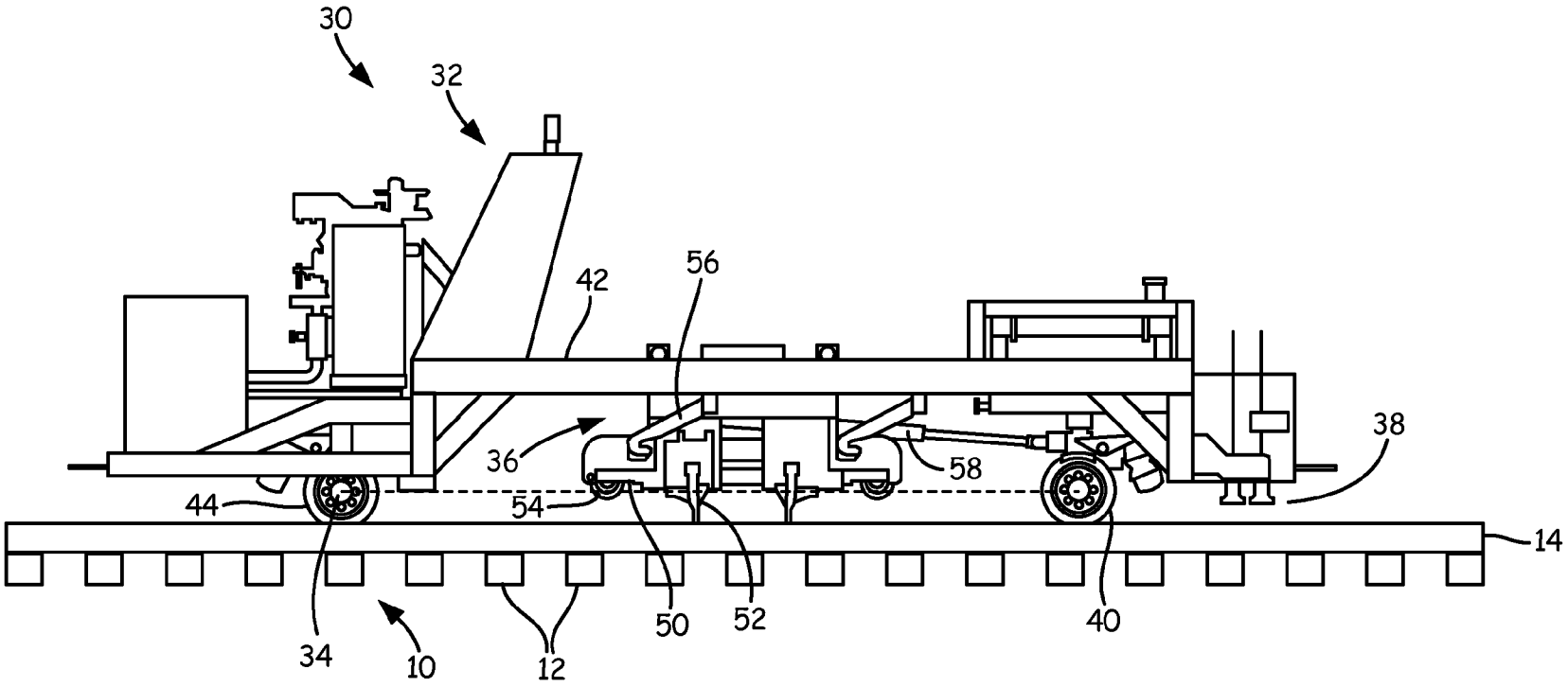
FIG. 1 is a side view of an exemplary maintenance vehicle.
Figure 2:
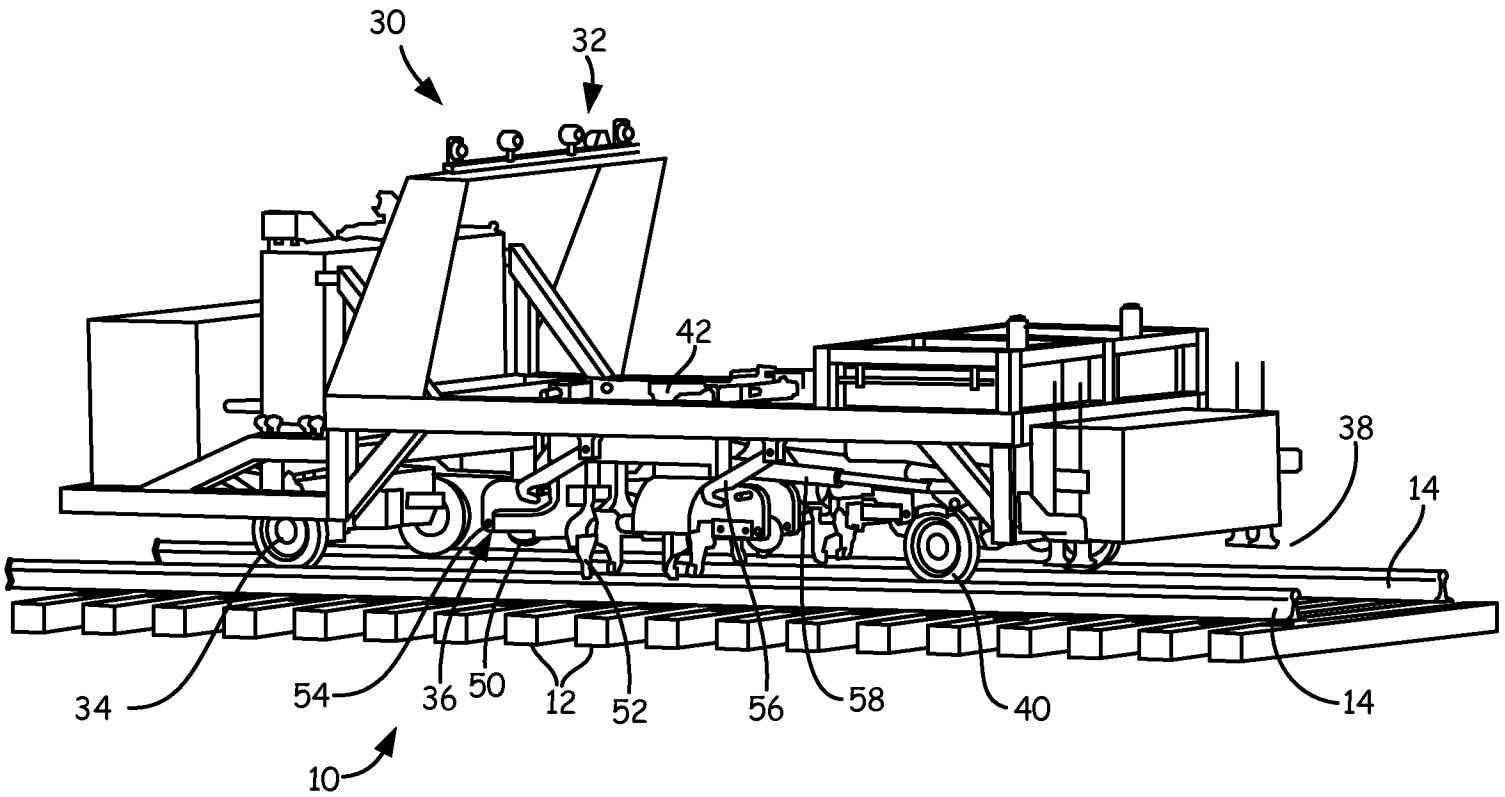
FIG. 2 is a perspective view of an exemplary maintenance vehicle.
Figure 3:
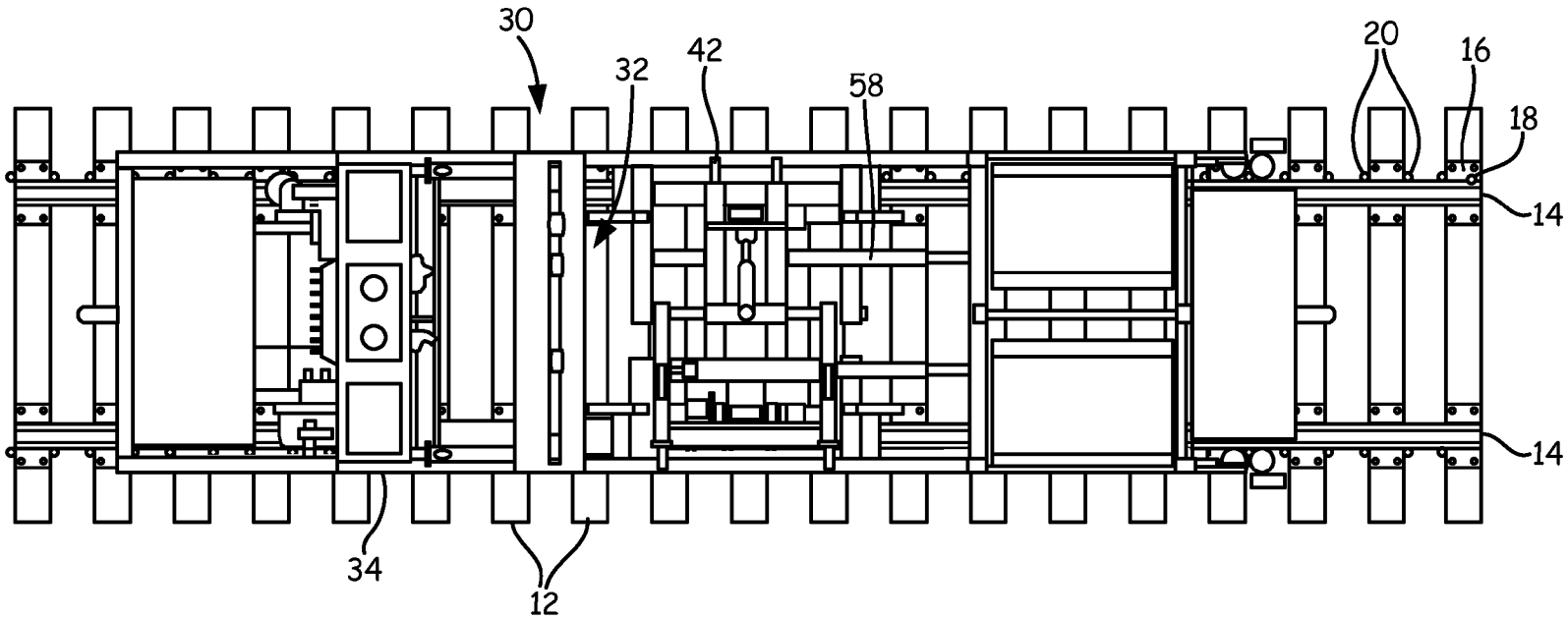
FIG. 3 is a top view of an exemplary maintenance vehicle.
Figure 4:
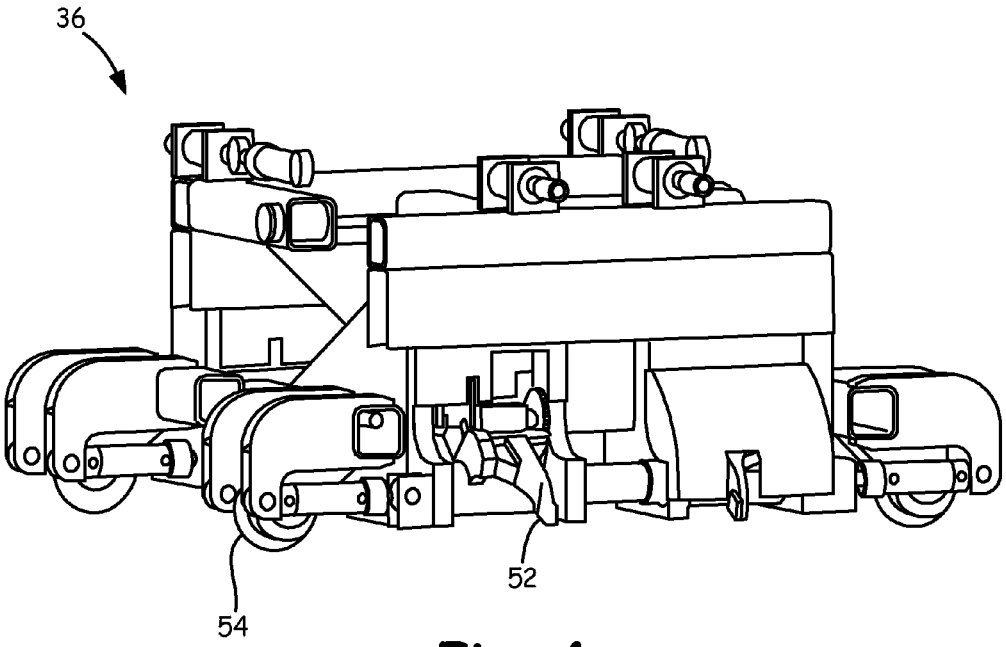
FIG. 4 is a perspective view of an exemplary work head that may be used in a maintenance vehicle.

Referring to FIGS. 1-3, a railroad 10 includes a plurality of substantially parallel, elongated ties 12. The ties 12 are disposed on a ballast substrate (not shown), which is typically a hard particulate material such as, but not limited to, gravel. One or more pairs of rails 14 are coupled to the upper side of the ties 12 and extend generally perpendicularly to each tie 12.

Figure 5:
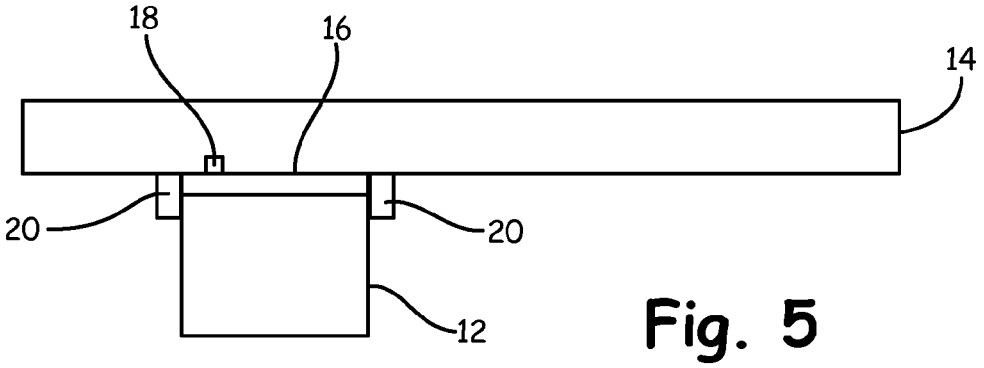
FIG. 5 is a side view of an exemplary railroad.

Referring to FIG. 5, a tie plate 16 fits between the rail 14 and the tie 12, with a plurality of spikes 18 passing through the tie 12 and tie plate 16, and having their heads overlap a bottom flange of the rail 14. The spikes 18 and tie plate 16 secure the rail 14 against transverse movement with respect to the tie 12. One or more rail anchors 20 are secured, for example by clamping, to the rail 14 at a side or sides of the tie 12. The rail anchor 20 acts to prevent longitudinal movement of the rail 14 during train traffic and/or thermal expansion and contraction of the rails 14. The rail anchors 20 may be of various types that include a flat bar type and a U-shaped spring steel type. In some embodiments, rail anchors 20 are approximately 1" wide and ½" thick.

Autonomous Drone Vehicle

Referring back to FIGS. 1-4, a maintenance vehicle 30 may perform track maintenance operations with little or no involvement from an operator. The track maintenance operations may include one or more of ballast tamping, spike pulling, spike driving, anchor spreading, anchor squeezing, track stabilizing, crib booms, tie extracting, or other maintenance operations. The exemplary track maintenance vehicle of FIGS. 1-4 is adapted for adjusting rail anchors.

The vehicle 30 includes a vehicle body 32, a propulsion device 34, work head assemblies 36, a tie locator 38 and an associated encoder 40. The vehicle body 32 includes a frame 42 and plurality of rail wheels 44 coupled to the vehicle frame. The vehicle rail wheels 44 are further structured to travel over the rails 14. The vehicle propulsion device 34 is structured to propel the vehicle 30 along the rails 14.

In some embodiments, the vehicle encoder 40 may be fixed to the vehicle body 32 and provided as or coupled to a wheel structured to roll over one of the rails 14. Other locations for the encoder are contemplated, such as within a hub of one of the rail wheels 44, or positioned to roll over one of the rail wheels 44, attached to an axle of the vehicle 30, etc. The vehicle encoder 40 provides information that may be used to determine the distance the vehicle 30 moves and/or the speed of the vehicle 30. The vehicle encoder produces a signal that has a relationship to the distance or speed of the vehicle 30 such that the distance and/or speed can be determined. For example, the encoder 40 may have a known diameter and produce a signal with a known quantity or pattern of pulses for each revolution. Thus, by analyzing the pulses, the distance and/or speed that the vehicle body 32 travels from a particular location may be determined. Since the diameter of the rail wheels 44 is generally fixed, if either the distance or speed that the vehicle body travels is known, the other parameter can be determined.

The tie locator 38 is located forward of the work heads 36 in a forward travelling direction of the vehicle 30 and may be located at the forward end of the vehicle 30. In some embodiments, the tie locator 30 is provided on an extension that extends in front of the vehicle body 32. Two tie locators 38 may be positioned on the vehicle 30, with one positioned over each rail 14 to allow the tie locators 38 to detect if a tie is skewed, for example. The tie locator 38 has a determinable distance from the vehicle body 32 and more specifically from the vehicle work heads 36. In some embodiments, the tie locator 38 may have a fixed position with a known distance between the tie locator 38 and the work heads 36. In other embodiments, the tie locator may have relative position with respect to the work heads 36. For example, the tie locator 38 and/or the work heads 36 may be adapted to raise and lower. The distance may be determined by positioning the tie locator 38 and/or work heads 36 against a stop or stops with known geometric characteristics. The distance may also be variable with the distance being determined based on measurements, such as from a transducer, of the position of the tie locator 38 and/or work heads 36.

The tie locator 38 may be any device that can locate a tie such as a metal detector that can detect the tie plate 16, or a photo detector or radar that can identify a tie. In the case of a metal detector, such a detector may record a peak when the detector is over the middle of the tie plate 16, and therefore the tie 12, as the tie plate 16 may extend from the forward side of the tie 12 to the rearward side of the tie 12.

As the distance between the tie locator 38 and the work heads 36 can be determined and the speed of the vehicle 30 can be determined, the location of the work heads 36 relative to the ties can thus be determined. In some embodiments, relative positions between elements such as the vehicle 30 and the ties 12 are used and the speed of the vehicle 30 is not referenced. The vehicle 30 can therefore determine, with little or no input from an operator, when the work heads 36 are positioned over a tie to perform track operations.

In some embodiments, the vehicle 30 includes additional instrumentation such as radars disposed on or near the front of the vehicle to scan for blockages of the railroad. In this manner, such radars may identify blockages and signal the vehicle 30 to cease operation until such blockages are cleared.

Figure 6:
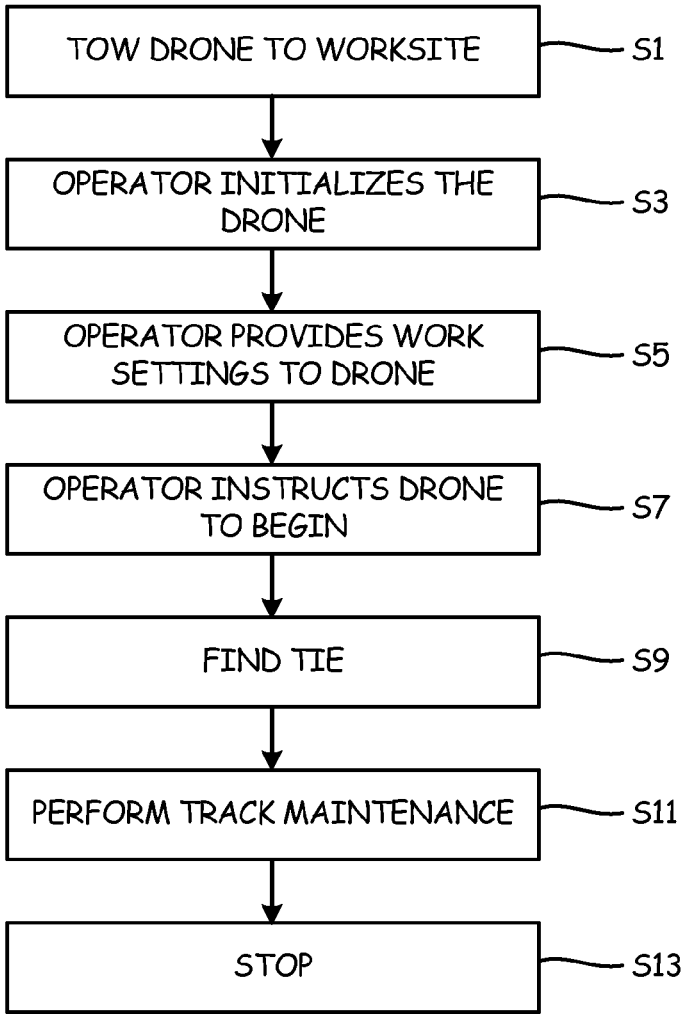
FIG. 6 is a flow diagram of an exemplary maintenance operation of an exemplary autonomous drone vehicle.

Referring to FIG. 6, an exemplary operation of an exemplary autonomous drone vehicle is shown. At Step S1, the autonomous drone is towed to the work site by another vehicle. At Step S3, an operator initializes the autonomous drone. Initializing the autonomous drone may include steps such as disengaging the autonomous drone from the tow vehicle, powering on the autonomous drone, etc. At Step S5, the operator provides work settings to the autonomous drone. Work settings may include whether each tie or every other tie is to be worked, information regarding the railroad, parameters for the work to be performed, etc. At Step S7, the operator instructs the autonomous drone to begin performing the maintenance operation. This is the last step in which activity by the operator is needed. From this step forward, the autonomous drone is capable of working independently.

At Step S9, the autonomous drone begins to move forward and starts detection of ties. Once a tie has been located, the autonomous drone determines when, based on the distance travelled, the tie will be located under the work head. Depending on the size of the autonomous drone, several ties may pass between the tie detector and the work heads. Therefore, the autonomous drone may be equipped with a computer memory in which it stores information about the detected ties until those ties reach the work head.

At Step S11, the autonomous drone performs the track maintenance operation when the detected tie reaches the work head. The process of Steps S9 and S11 repeats until the autonomous drone has completed the track maintenance operation, at which time Step 13 is reached and the autonomous drone stops.

The described process may be executed by a controller, a special purpose processor/computer or a general purpose processor programmed to execute the process. The correction process may also be in the form of computer executable instructions that, when executed by a processor, cause the processor to execute the correction process. The computer executable instructions may be stored on one or more computer readable mediums in whole or in parts. The instructions and/or the processor programmed to execute the process may be provided onboard the autonomous vehicle, in a device external to the autonomous drone (for example, on an operator control interface or another piece of work equipment) that is in communication with the autonomous drone, or a combination thereof.

Continuously Operating Vehicle

To perform maintenance operations, the work head should be located over a particular tie for a period of time sufficient to perform the work. One way to position the work head over the tie for this period is to stop the vehicle while the work is being performed. This results in cyclical acceleration and deceleration as the vehicle moves from tie to tie performing operations, which may increase energy use and wear on the vehicle.

Referring to FIGS. 1-4, the vehicle 30 may include a movement device 58 that moves the work head 36 in the forward and aftward directions relative to the vehicle body 32. The movement device 58 may be a hydraulic cylinder, an electric motor, or other actuator. The vehicle 30 may further include a work head encoder 54. The work head encoder 54 may be positioned at any location that permits the measurement of the relative position and/or speed between the work head 36 and the vehicle body 32. For example, the work head encoder 54 may be provided as a wheel that rolls against the vehicle frame 42 as the work head 36 moves. As another example, the work head encoder 54 may be provided within the movement device 58 to measure displacement of the actuation of the movement device 58.

It will be appreciated that the work head encoder 54 is not required and the speed and location of the work head 36 due to the actuation of the movement device 58 may be estimated. For example, characteristics of the movement device 58 along with the duration of actuation may be used to estimate the location of the work head 36 relative to the vehicle body 32. Whether or not the work head encoder 54 is included, the movement device 58 may be driven against a foremost or aftmost stop to provide a zero point for determination of the location of the work head 36 relative to the vehicle body 32.

As the vehicle 30 moves forward and the movement device 58 is driven to displace the work head 36 in an aftward direction, the relative speed of the implement end 52 relative to the rail 14 and ties 12 is reduced. When the forward speed of the vehicle 30 relative to a tie 12 and the aftward displacement of the work head 36 relative to the vehicle body 32 are approximately the same, the work head 36 remains approximately stationary relative to the tie 12 and work can be performed as if the vehicle 30 were at a lower speed or stopped while the vehicle 30 maintains a continuous forward motion.

In one embodiment, the movement device 58 is driven to position the work head 36 in its forward most displacement relative to the vehicle body 32. The vehicle 30 is driven in a forward direction. When the work head 36 reaches a tie 12 for which work is to be performed, the movement device 58 begins to drive the work head 36 aftward relative to the vehicle body 32 and the work head 36 performs the work on or around the tie 12. When the work is completed, the movement device 58 is driven to position the work head 36 in the forward direction relative to the vehicle body 32 in preparation for reaching the next tie 12.

In some embodiments, the speed of the vehicle 30 may be provided from information collected by the vehicle encoder 40 or by control of the propulsion device 34. The speed of the displacement due to the actuation of the movement device 58 may be provided from information collected by the work head encoder 54. The vehicle 30 is operated to control these speeds, for example by controlling the propulsion device 34 and/or the movement device 58, to be approximately equal.

In some embodiments, the work head 36 is lowered into place to perform work on a tie 12 and raised to clear the tie 12 in order to move to the next tie 12. The work head 36 may be attached to the vehicle frame 42 via a set of arms 56 and an actuator 58. When the actuator 58 is extended, the work head 36 is raised such that the implement end 52 is above the ties 12. When the actuator 58 is retracted, the work head 36 is lowered into position to perform work.

Anchor Adjustor

Figure 7:
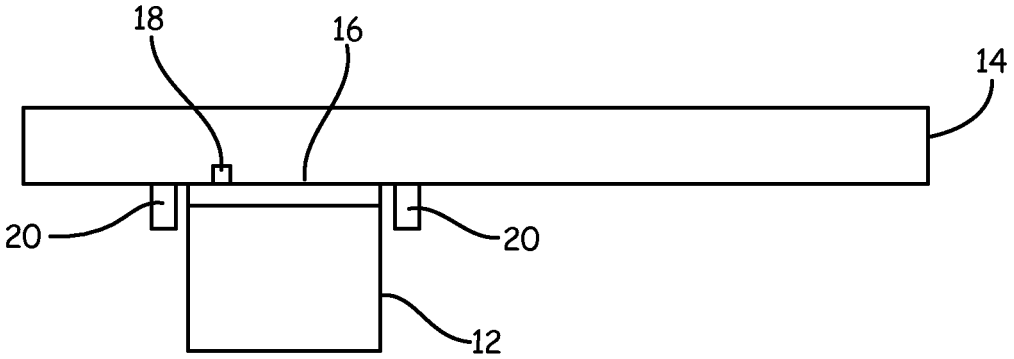
FIG. 7 is a side view of an exemplary railroad with loose anchors.

Improved work heads allow for reduced operator involvement. Referring to FIG. 7, a railroad similar to that of FIG. 5 is shown. The anchors 20' have shifted away from the tie plate 16 and the tie 12. The anchors 20' may shift from stresses exerted on the ties 12 from loads passing on the rails 14. The anchors 20' may also be shifted away from the tie 12 intentionally during a tie replacement operation. Therefore, it becomes necessary to periodically adjust the anchors 20' to reposition them against the tie plate 16 and the tie 12.

Conventional techniques for adjusting anchors involve a large scissor-like device that opens surrounding a tie 12 and presses the anchors 20' towards the tie 12 when the scissor-like arms are closed. An adjustor mechanism may include four of such large scissor-like devices that are lowered between the ties 12 and behind the anchors 20' to properly position the large scissor-like devices prior to squeezing the anchors 20' against the tie 12. The force required to slide the anchors 20' on the rail can be as high as 16,000 lbs; therefore, a large mechanical advantage is required in a mechanism to squeeze the anchors on the tie. Conventionally, a hydraulic cylinder is connected to one end of the two vertical bars having a common rotating central pivot forming the large scissor-like arrangement. The opposite end of each bar has a hardened tool that comes in contact with the anchor 20' and pushes the same against the tie 12 when the hydraulic cylinder is extended.

The operation of such a scissor-like devices requires careful monitoring by an operator. The operator must vertically deploy the squeezer arms of the large scissor-like device after stopping the machine on the tie and apply multiple squeeze functions until the anchors are set.

During the lowering of these bars, contact with the top of the anchors can be made resulting in the anchor being dislodged an falling between the ties. The anchors 20' may require a special machine to attach the anchors to the rails. If the anchors 20' are dislodged from the rails 14, significant inconvenience and additional work to replace the anchors may be caused.

Figure 8:
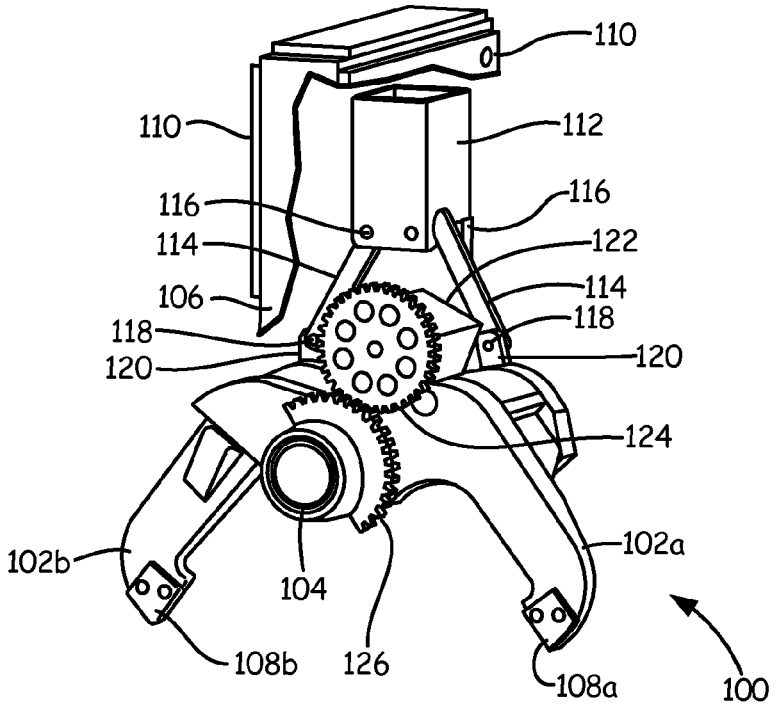
FIG. 8 is a perspective view of an exemplary anchor adjustor in a substantially open state.
Figure 9:
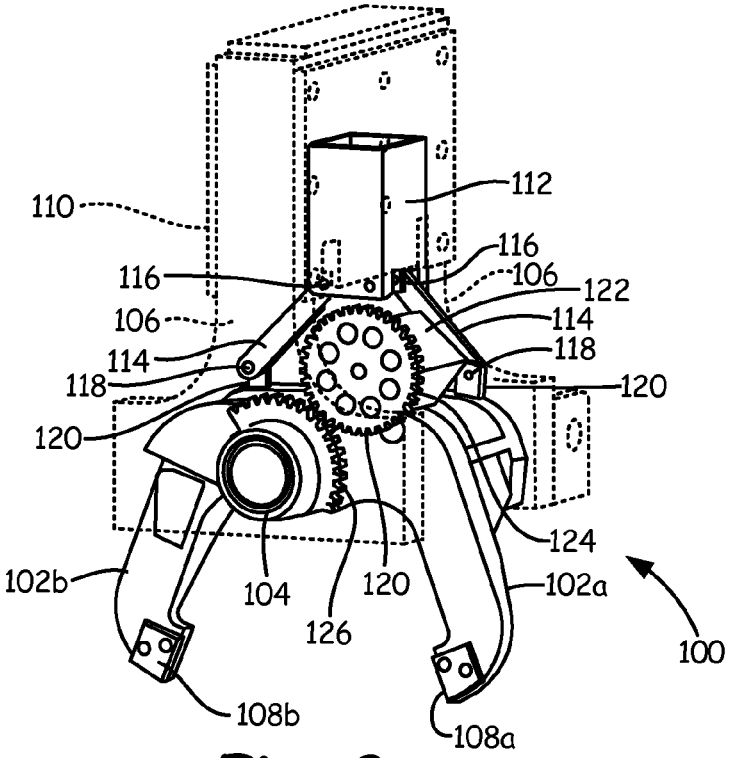
FIG. 9 is a perspective view of an exemplary anchor adjustor in a partially closed state.
Figure 10:
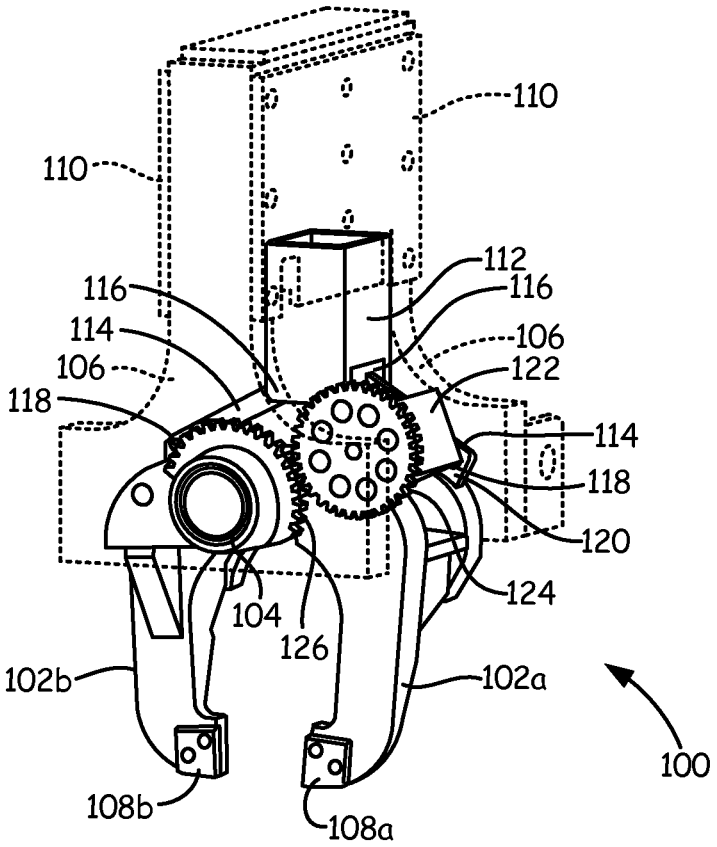
FIG. 10 is a perspective view of an exemplary anchor adjustor in a substantially closed state.

Referring to FIGS. 8-10, an anchor adjustor 100 includes a pair of jaws 102*a* and 102*b* (jaws 102). The jaws 102 rotate about an axis 104. The axis 104 may be provided by a pipe or tube, an axle, or a similar structure. The axes 104 is secured to frame members 106. Frame members 106 extend away from anchor contact plates 108 of the jaws 102 and are fastened together with frame members 110. Frame members 106 and 110 define a space in which carriage 112 travels. Carriage 112 is connected to each of the jaws 102 via the arms 114. At the connection between the carriage 112 and the arms 114, the arms 114 are free to rotate at pivot points 116 about axes that are parallel with the axis 104. At the connection between the arms 114 and the jaws 102, the arms 114 are free to rotate at pivot points 118 about axes that are parallel with the axis 104. The connection point between the arms 114 and the jaws 102 may be provided on a tab 120 protruding from the jaws 102 respectively.

A motor 122 is secured to the jaw 102*a*. A gear 124 is connected to the output shaft of the motor 122. A gear 126 is secured to the jaw 102*b*. In some embodiments, the gear 126 is a partial gear or a half gear. The teeth of the gears 124 and 126 are engaged such that rotation of one of the gears 124 and 126 causes rotation of the other.

When the motor 122 is driven to rotate its output shaft, the jaws 102, which are connected by way of the engaged gears 124 and 126, are caused to rotate with respect to each other about the axis 104. As the jaws 102 rotate, the arms 114 exert a force on the carriage 112 causing the carriage 112 to translate within the space defined by the frame members 106 and 110. The space defined by the frame members 106 and 110 constrains the freedom of movement of the carriage 112, which in turn constrains the rotation of the jaws 102 about the axis 104. Therefore, when the motor 122 is driven, the jaws 102 remain approximately equidistant from a center line of the anchor adjustor 100.

Figure 11:
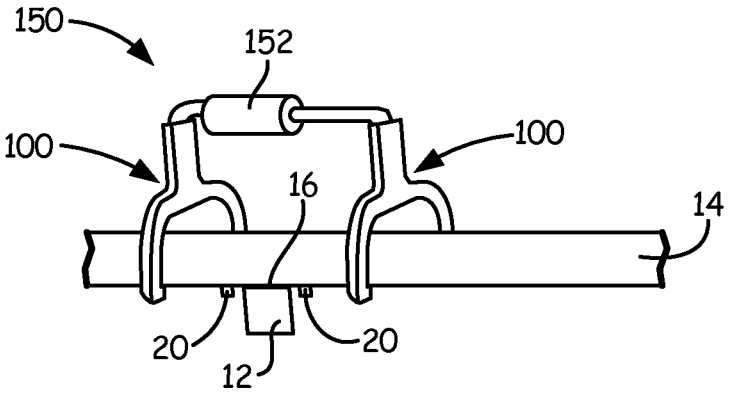
FIG. 11 is a side view of an exemplary working head employing the anchor adjustor of FIGS. 8-10.

Referring to FIG. 11, a working head 150 for anchor adjustment includes two anchor adjustors 100. The axes 104 of the anchor adjustors 100 is parallel with the longitudinal direction of the rail 14. Therefore, the jaws 102 open and close about the rail 14. The anchor adjustors 100 are connected to each other via the actuator 152, which translates the anchor adjustors closer together and father apart in the longitudinal direction of the rail 14. The actuator 152 may be a hydraulic actuator, a pair of parallel hydraulic cylinders located between or outside of the anchor adjustors 100, or another type of actuator. Longitudinal tubes parallel to the rails 14 may be provided for the anchor adjustors to slide along.

The working head 150 is positioned such that the anchor adjustors 100 surround the rail 12 and the jaws 102 of the anchor adjustors 100 are closed. Then, the actuator 152 pushes the anchor adjustors 100 together until the anchor contact plates 108 come into contact with the anchors 20' from behind the anchor 20' and the anchors 20' are repositioned. The closed gap between the anchor contact plates 108 of the anchor adjustors 100 when the actuator 152 is fully extended (or in alternative embodiments retracted) corresponds with the required opening for the two anchors 20' to be positioned on the tie 12. Contact with the anchors 20' is made from a side of the anchor 20' along a side of the rail 14 thereby reducing the risk of a contact from the top of the anchor that could dislodge the anchor.

Although one working head is shown, it will be appreciated that another head (or heads) may be provided at the other rails of the railroad. This plurality of working heads may be independently controllable such that each side may be independently slewed longitudinally and parallel to the rail thus allowing positioning and adjustment of the anchors on the left and right side of the tie. This function accommodates the adjustment of anchors on slewed ties.

Continuously Operating Drone Anchor Adjustor

The above described autonomous drone vehicle, continuously operating vehicle, and anchor adjustor may be implemented separately or together. When combined, a continuously operating drone anchor adjustor is synergistically provided. Once initialized, the continuously operating drone anchor adjustor autonomously detects ties and positions the work head over the ties. The work head may be repositioned with respect to the vehicle such that anchor adjustment operation can be continuously performed without the need to stop the vehicle. Therefore, the anchor adjustment operation can be performed more quickly and with less wear on vehicle components.

Another exemplary benefit of the described embodiments is that an unmanned machine is provided to find the ties, position the anchor adjustors around the center of the tie, deploy the anchor adjustors to squeeze the anchors on both sides of the of the tie below each rail, and advance to the next tie. The improved anchor adjustor does not require the supervision of an operator and is configured such that the risk of dislodgement of anchors is reduced. This continuous operation conducted automatically reduces the need for separate machines and operators, for example replacing two machines and two operators.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

The invention claimed is:

1. A track maintenance vehicle for performing maintenance on a track, comprising:
- a body;
- one or more work heads that perform track maintenance coupled to the body;
- a controller configured to operate the vehicle in an autonomous mode; and
- a tie locator that includes a metal detector configured to detect a tie plate, wherein
- the tie locator is configured to provide information indicating the location of ties in the track, and
- the controller is configured to receive the information indicating the location of the ties and control the work heads based on the location of the ties, wherein
- the one or more work heads include an anchor adjustor work head,
- the anchor adjustor includes
  - a first pair of jaws that opens and closes about a rail in the track,
  - a second pair of jaws that opens and closes about the rail in the track disposed a distance from the first pair of jaws in the longitudinal direction of the rail, and
  - an actuator that forces the closed first pair of jaws to translate towards the closed second pair of jaws,
- the first pair of jaws includes
  - a first jaw and a second jaw that pivot about a single axis, and
  - an actuator that causes the first jaw and the second jaw to rotate about the axis,
- the actuator that causes the first and second jaws to rotate about the axis is a motor,
- the motor is connected to the first jaw,
- a first gear is connected to the motor, and
- a second gear is connected to the second jaw, the second gear being engaged with the first gear.

2. The track maintenance vehicle of claim 1, further comprising
- an encoder device that detects a speed or displacement of the vehicle, wherein
- the controller is configured to determine when a tie detected by the tie locator is positioned at at least one work head based on the speed or displacement of the vehicle.

3. The track maintenance vehicle of claim 2, further comprising
- a movement device that moves the one or more work heads with respect to the body, wherein
- the controller is configured to cause the movement device to move the one or more work heads in a direction opposite to a direction of travel of the track maintenance vehicle.

4. The track maintenance vehicle of claim 3, further comprising a second encoder that detects a speed or displacement of the work heads with respect to the body.

5. The track maintenance vehicle of claim 4, wherein the controller is configured to cause the movement device to move the one or more work heads in the direction opposite to the direction of travel of the track maintenance vehicle at approximately the same speed as the speed of the vehicle.

6. The track maintenance vehicle of claim 1, wherein the first pair of jaws includes a housing that defines a space, a carriage disposed within the space of the housing, a first arm connecting the carriage to the first jaw, and a second arm connecting the carriage to the second jaw, wherein rotation of the first and second jaws cause the carriage to move within the housing.

7. The track maintenance vehicle of claim 6, wherein the carriage moves along an axis orthogonal to the axis about which the first and second jaws pivot.

8. The track maintenance vehicle of claim 6, wherein the first pair of jaws includes a pivot member disposed along the axis about which the first and second jaws pivot.

9. The track maintenance vehicle of claim 8, wherein the pivot member is a tube.

10. The track maintenance vehicle of claim 9, wherein the tube is connected to the housing.

* * * * *